US005199817A

United States Patent [19]

Wagner et al.

[11] Patent Number: 5,199,817

[45] Date of Patent: Apr. 6, 1993

[54] PROCESS OF PROVIDING AN ELONGATE UNDERGROUND CAVITY

[75] Inventors: Harald Wagner, Mauthausen; Alfred Schulter, Linz, both of Austria

[73] Assignee: Mayreder Consult of the United States, Inc., Bowie, Md.

[21] Appl. No.: 875,247

[22] Filed: Apr. 28, 1992

[30] Foreign Application Priority Data

Sep. 4, 1991 [AT] Austria ..... 1744/91

[51] Int. Cl.[5] ..... E21D 9/00

[52] U.S. Cl. ..... 405/139; 405/138; 405/150.2; 405/132

[58] Field of Search ..... 405/134, 135, 139, 142, 405/144, 145, 146, 147, 150.1, 150.2, 55, 132, 138

[56] References Cited

U.S. PATENT DOCUMENTS

| | | | |
|---|---|---|---|
| 2,055,876 | 9/1936 | Newman | 405/139 |
| 3,616,650 | 11/1971 | Eber et al. | 405/139 |
| 3,968,655 | 7/1976 | McGlothlin | 405/139 |
| 3,990,249 | 11/1976 | Senn | 405/150.2 X |
| 3,996,751 | 12/1976 | Hallenius et al. | 405/139 |
| 4,147,452 | 4/1979 | Ogasawara et al. | 405/134 |
| 4,808,030 | 2/1989 | Takegawa | 405/142 X |
| 4,929,123 | 5/1990 | Lunardi | 405/150.1 X |
| 4,976,290 | 12/1990 | Gelin et al. | 405/150.1 X |

*Primary Examiner*—Dennis L. Taylor
*Assistant Examiner*—J. Russell McBee
*Attorney, Agent, or Firm*—Kurt Kelman

[57] ABSTRACT

In the provision of elongate underground cavities having a large volume are to be provided, particularly in the construction of underground railroad stations having at least two stories, it is desired to avoid a need for excavating an open pit and to minimize the handling of material. This is accomplished in that the cavity is excavated and lined in a two consecutive stages. In the first stage, two laterally spaced apart galleries are driven in the longitudinal direction of the cavity by a mining technique in the region of a top segment of the desired cavity and are formed each with an outer side face, which constitutes a portion of a side face of said top segment. Only one of said galleries is driven at any given time in any given cross-section of said top segment. Each of said galleries is provided on said outer side face with a supporting permanent first lining. The ground between said two galleries is removed to complete the excavation of said top segment. Said first linings are supplemented by an additional permanent lining to form a structural vault. In the second stage the bottom segment is excavated under the cover of the lining of said top segment.

9 Claims, 7 Drawing Sheets

PROCESS OF PROVIDING AN ELONGATE UNDERGROUND CAVITY

BACKGROUND OF THE INVENTION

1. Field of the Invention

This invention relates to a process of providing an elongate underground cavity having a large volume, particularly in the construction of underground railroad stations having at least two stories, or to provide cavities for superposed or intersecting underground traffic routes.

2. Description of the Prior Art

In the prior art such large-volume cavities have been provided as far as possible by cut-and-cover construction work. For that purpose it is necessary to excavate a pit having virtually the same area as the entire bottom surface of the cavity and then to install the internal fixtures and the means for supporting the walls and the top of the cavity. Thereafter the pit is filled up to the original surface level. In a modification, known as cover-shielded construction work, an excavation is initially made only to the level of the ceiling of the desired cavity and a structural cover of concrete is installed there, whereafter the pit is optionally refilled and the region under the cover is excavated and removed by a mining technique under the cover. In that construction method the pit is open only for a shorter time but the same basic disadvantages will arise as in the first-mentioned known method of construction because an open pit is required, which is susceptible to influences of the weather and particularly in urban regions will interfere with the traffic and will result in a destruction of the environment and/or in damage to roads and buildings.

SUMMARY OF THE INVENTION

It is an object of the invention to provide a process which is of the kind described first hereinbefore and in which even cavities having a large volume, e.g., for the above-mentioned underground railroad stations, can be made merely by a mining technique so that open pits are not required.

That object is accomplished in that the cavity is excavated and lined in two consecutive stages. In the first stage, two laterally spaced apart galleries are driven in the longitudinal direction of the cavity by a mining technique in the region of a top segment of the desired cavity and are formed each with an outer side face, which constitutes a portion of a side face of said top segment. Only one of said galleries is driven at any given time in any given cross-section of said top segment. Each of said galleries is provided on said outer side face with a supporting permanent first lining. The ground between said two galleries is removed to complete the excavation of said top segment. Said first linings are supplemented by an additional permanent lining to form a structural vault. In the second stage the bottom segment is excavated under the cover of the lining of said top segment.

The process in accordance with the invention permits an economical excavation of large-volume cavities. For instance, in the construction of underground railroad stations it will be possible to use the machines for driving the underground tubular tunnels also for driving the galleries in the region of the top segment. Because each gallery is provided with a supporting permanent lining, the soil or rock will not substantially be disturbed at the galleries and during the removal of the ground between the galleries it is possible to provide only a small open span between the rock regions which are already protected and supported by the apices of the gallery linings. Besides, anchors or other means or actions for consolidating the rock or soil may be provided from the galleries. Such actions applied to the rock region which bridges the finally excavated space may consist, e.g., of an injection of additional concrete into said rock region. Besides, during the excavation of the ground between the galleries it is possible first to form only spaced apart apertures near the top and to introduce supports, through said apertures so that an adequate safety will be ensured even in difficult soil. After the top segment has been lined the subsequent operations can generally be performed like the operations performed under the cover used in cover-shielded construction work. That practice will result in the additional advantage that the top segment can initially be provided with a permanent lining and it is sufficient to excavate the top segment in a cross-section having the desired final shape. The dimensions of the lining and of its reinforcement must be selected in view of local conditions and of the inherent load-carrying capacity of the rock which is disposed over the cavity and is left undisturbed. The supply and removal of material can be effected to and from a suitable location through the galleries which extend to said locations and which in case of an underground railroad station can be caused to communicate with the tubular tunnel or tunnels.

In the excavation of the top segment the two galleries may be driven one after the other or may be driven at the same time at locations spaced apart in the longitudinal direction of the desired cavity.

The lining of the top segment may be retained by various measures, which are partly known per se. If it is necessitated by the rock the lining for the top segment of the cavity may be retained and supported by additional piles, which outside the cross-section of the desired cavity are driven in an outwardly and downwardly inclined direction from the bottom edges of the lining of the top segment.

Each gallery may initially be provided at its bottom and on its inner side face with a temporary lining, which may be made of quick-setting concrete and which is removed as the ground between the galleries is removed. Alternatively, the temporary lining may consist of pre-fabricated elements, such as segments of tubular liners.

To increase the stability and to avoid as far as possible in the excavation of the bottom segment a slipping of undisturbed soil or rock, it is recommended to provide after the complete excavation of the top segment under said top segment, a continuous membrane, which is preferably made of quick-setting concrete. That membrane will also facilitate vehicular traffic in the top segment and will assist in avoiding a loosening of the rock which supports the lining of the top segment.

According to a further feature the final excavation of the bottom segment of the cavity is preceded by an erection of central supporting means, such as pillars or a continuous wall, in said bottom segment, which supports serve to support the lining of the top segment of the cavity, and/or by the installation of a bottom slab for a top story, which bottom plate is supported directly by said supports. The supports may be anchored in the undisturbed rock below the cross-section of the desired cavity. A continuous wall as well as a bottom slab for the top story will increase the carrying capacity of the lining of the top segment.

In the construction of an underground railroad station different procedures may be adopted for the excavation of the bottom segment. This will depend on whether the driving of the tubular tunnels for the underground railroad is to proceed from the large-volume cavity after it has been provided or has been started at a different location and has already proceeded close to the intended underground railroad station. In the latter case the process in accordance with the invention is preferably carried out in that two tubular tunnels which are spaced apart and spaced from the final contour of the bottom segment of the desired cavity are driven in the region of that bottom segment and are provided with temporary linings and the excavation of the bottom segment is continued from said tubular tunnels and from the top segment. That mode of excavating the bottom segment can be carried out quickly. The tubular tunnels desirably extend close to the side faces of the desired bottom segment so that the final excavation as far as to said side faces will not result in substantial disturbances. Because an excavation is effected from the tubular tunnels and from the top segment, the bottom segment of the cavity will be excavated quickly.

A different embodiment will mainly be adopted if the driving of the tubular tunnels is to proceed from the underground cavity which has been provided or if the underground cavity is to be provided for different purposes. In that embodiment a central trench is initially excavated from the top segment in the region of the bottom segment and is lined, the center supports for the bottom slab of the top story are erected in said trench, and the side portions of the bottom segment are then excavated from that central trench and are lined.

The lining of the top segment is desirably independently supported on the soil or rock by protruding feet and/or the piles and the lining of the bottom segment may be designed to take up only light loads. Only in special cases, in rock which can carry only light loads or if the entire cavity must be sealed, may the lining of the bottom segment also constitute a load-carrying structure, which is joined to the lining of the top segment.

Further details and advantages of the invention will become apparent from the following description of the drawing with reference to the drawing.

DETAILED DESCRIPTION OF THE PREFERRED EMBODIMENTS

Figure 1:
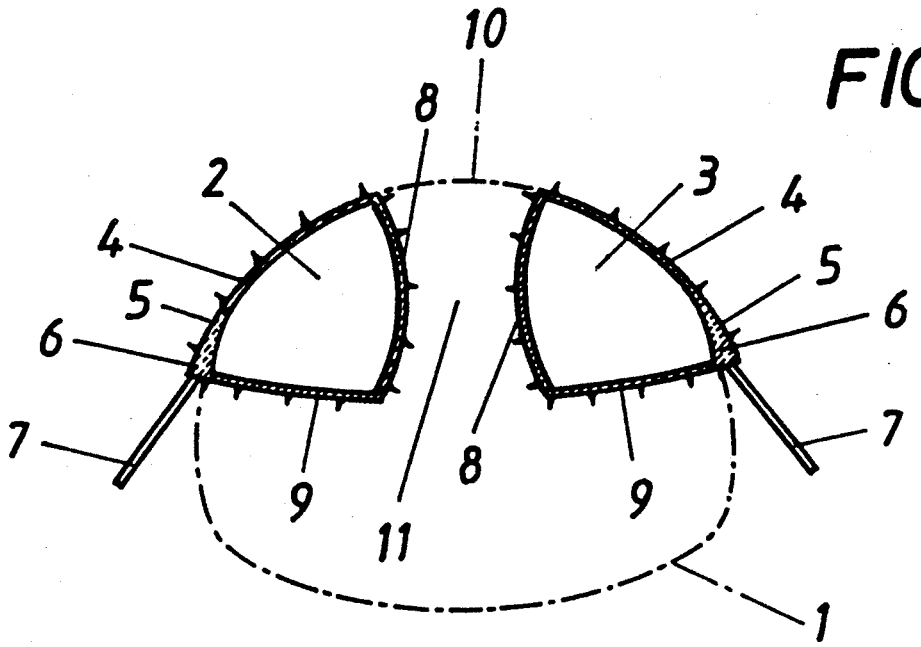
FIGS. 1 to 6 illustrate consecutive stages in the excavation and lining work performed in the construction of a two-story underground railroad station in schematic transverse sectional views of the station region.
Figure 7:
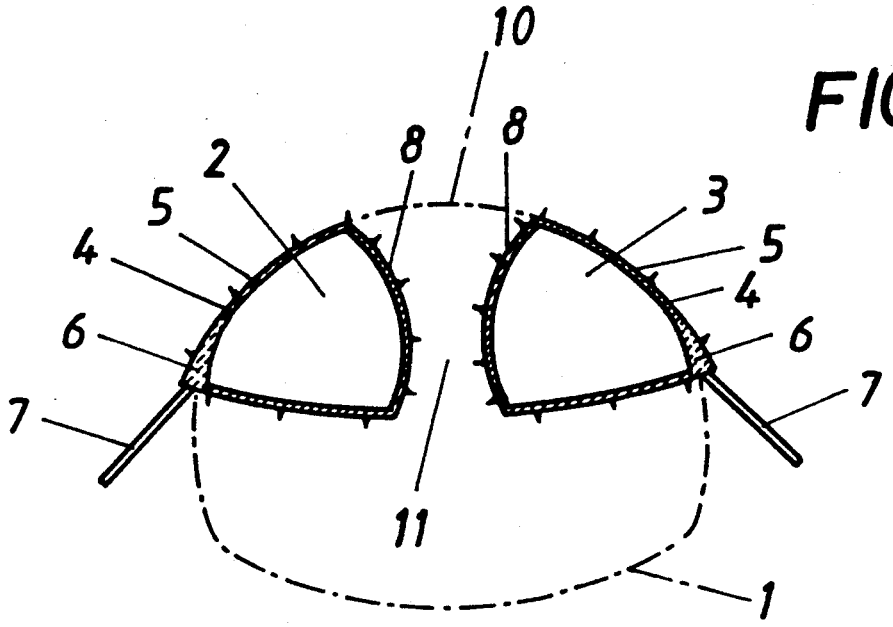
FIGS. 7 to 14 are similar views illustrating a modification particularly of the provision of the bottom segment of the cavity.

According to FIGS. 1 to 5 and 7 to 11 the periphery of the cross-section of the desired underground cavity is represented by a phantom line 1. According to FIGS. 1 and 7 two galleries 2, 3 are initially driven in succession in the region of a top segment, which extends over the largest width of the cross-section of the desired cavity. One outer side face 4 of each of said galleries constitutes a part of the side face of the top segment. On that outer side face 4 each gallery is provided with a supporting permanent lining 5, which comprises a foot portion 6. The linings 5 may additionally be supported by inclined piles 7, which extend into the ground outwardly and downwardly from the foot portions 6. In each of the two galleries 2, 3 the linings 5 are supplemented by temporary linings 8 on the inner side face of the gallery and by a temporary bottom lining 9. The linings 8 and 9 are preferably made of quick-setting concrete, which may be reinforced. When the galleries have been driven and lined as shown in FIGS. 1 and 7, the two galleries 2, 3 constitute tubes having a closed shell, which can carry loads. The outer linings 5 may be retained by additional means, such as rock anchors. Besides, retaining anchors may be driven from the two galleries 2, 3 above the apex 10 of the cross-section of the desired top segment and actions to consolidate the soil and/or rock outside the contour 1, e.g., by an injection of concrete, may be taken.

Figure 2:
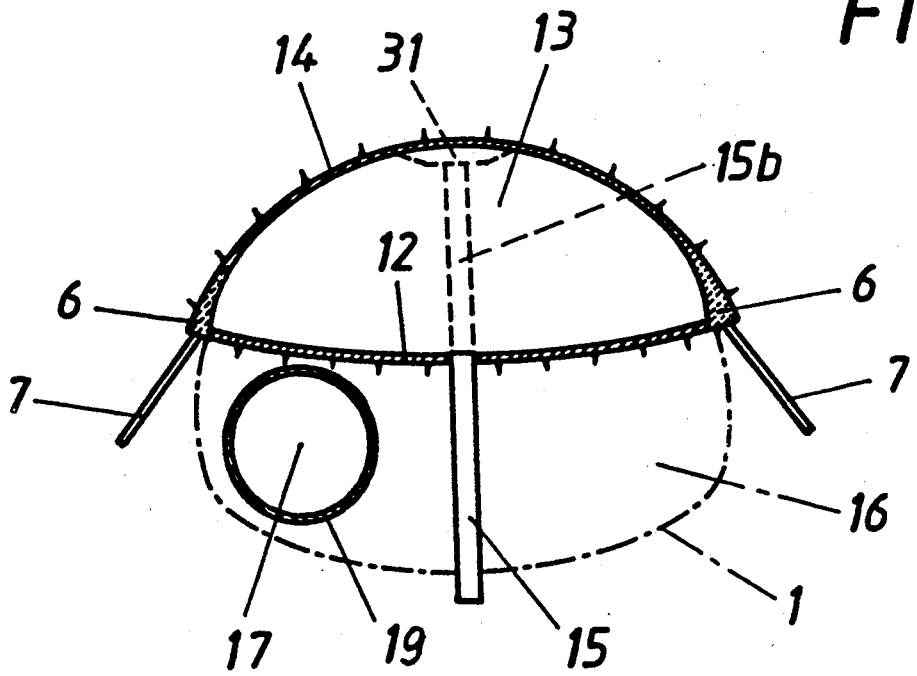
Figure 3:
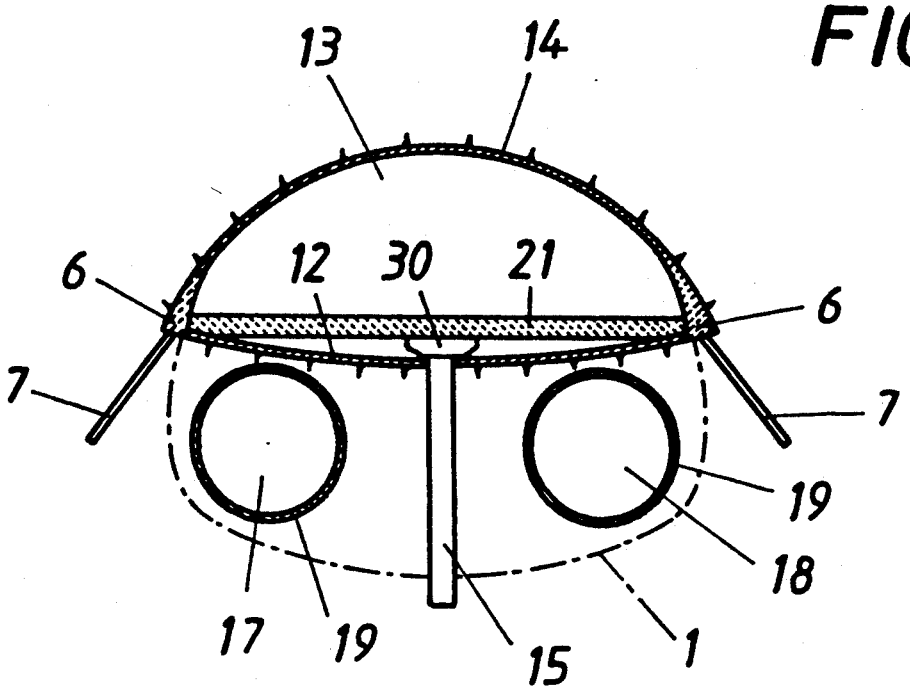
Figure 4:
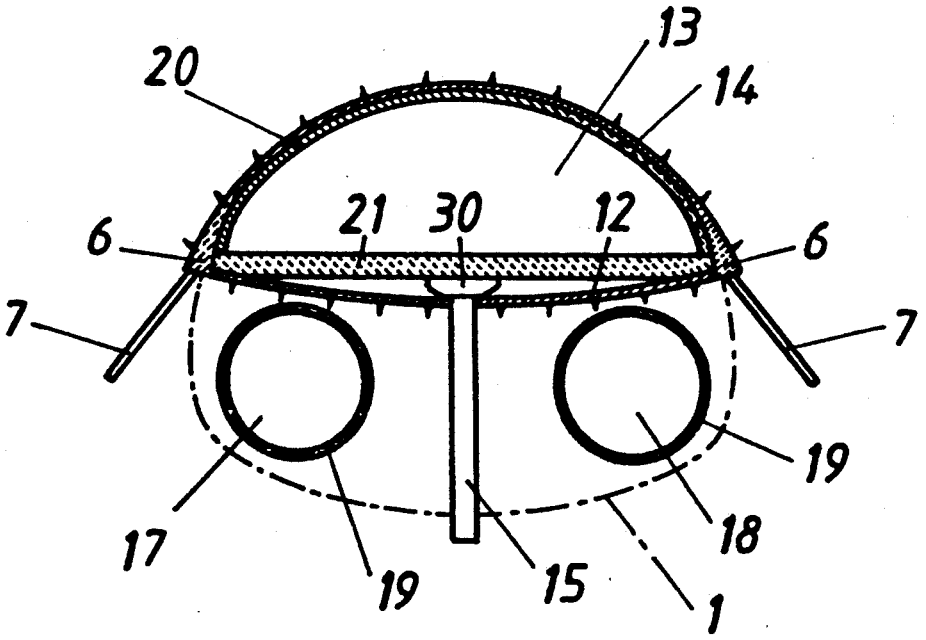
Figure 5:
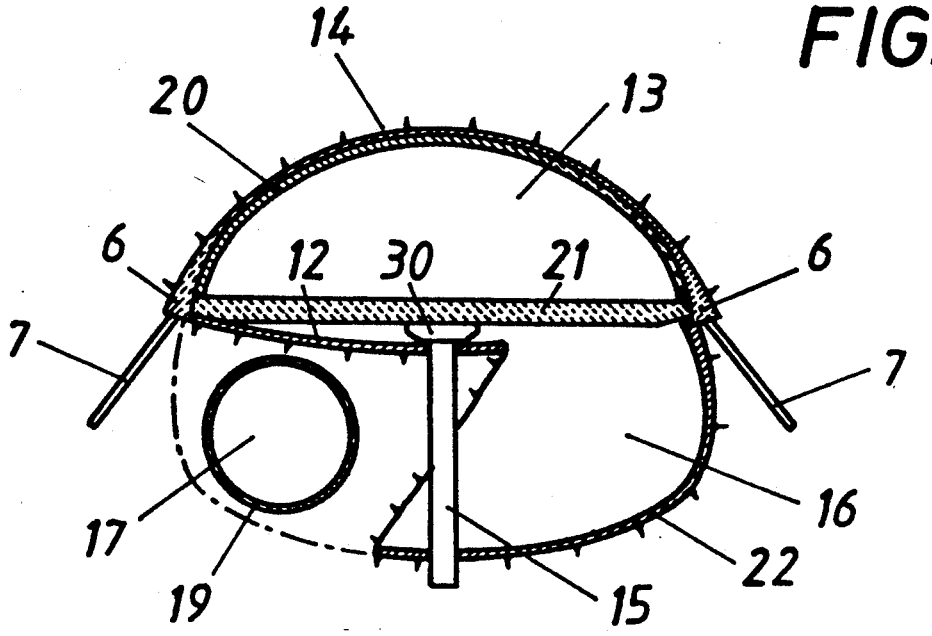
Figure 6:
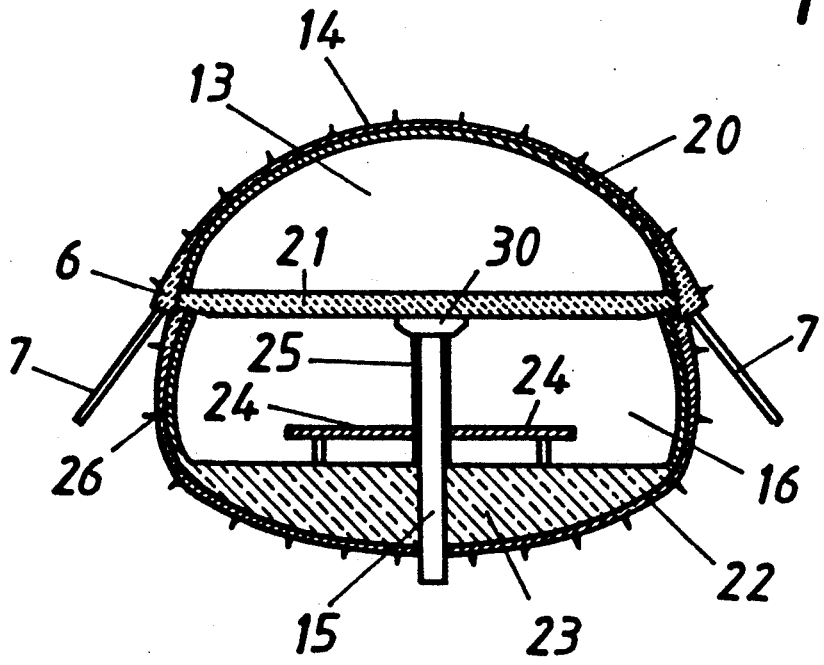
Figure 8:
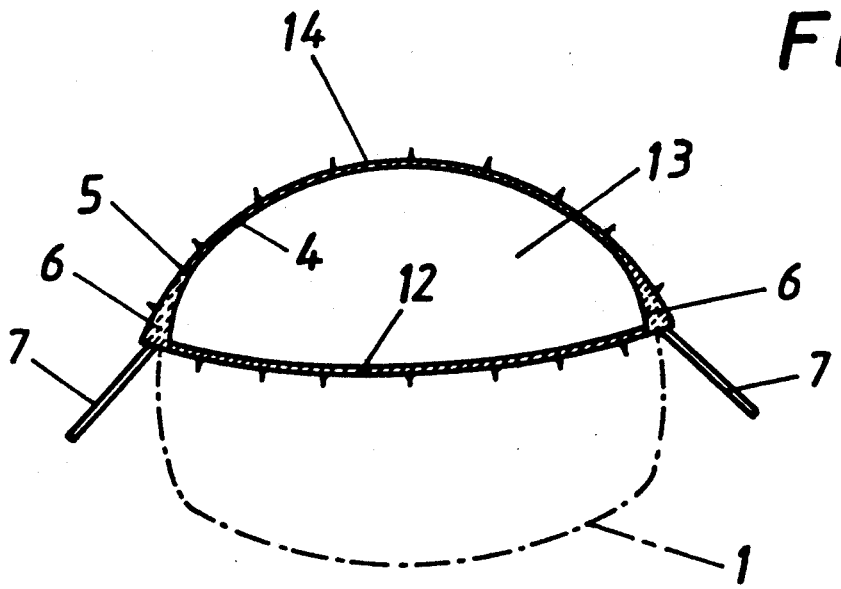
Figure 9:
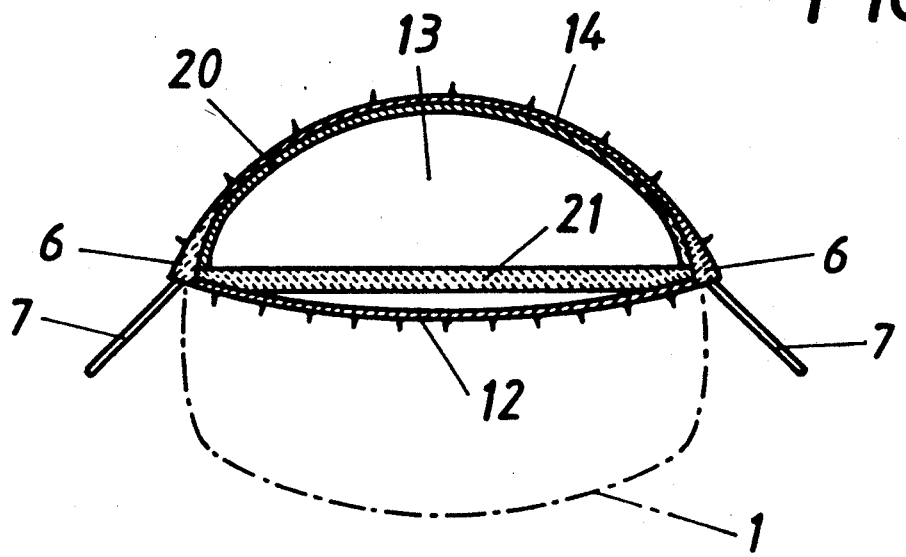

As is shown in FIGS. 2 and 8 the temporary linings 8 are then destroyed and the ground 11 between the galleries 2 and 3 is excavated and the bottom linings 9 are subsequently supplemented by a centerpiece to provide a continuous bottom membrane 12. The top segment 13 of the desired cavity has now been excavated and the linings 5 have been supplemented by a centerpiece to form a permanent lining 14, which is closed at the bottom by the membrane 12. The process can now be continued in different ways. According to FIGS. 2 to 6, apertures are formed in the membrane 12 and retaining and supporting pillars 15 are driven through such apertures to extend below the bottom of the contour 1 of the desired cavity. Thereafter, as is shown in FIGS. 2 and 3, two tubular tunnels 17 and 18 are consecutively driven in the region of the bottom segment 16 first on one side, as is shown in FIG. 2, and subsequently on the other side, as is shown in FIG. 3. Said line tunnels 17 and 18 are spaced on all sides from the contour line 1 and from the membrane 12 but are disposed close to the two side edges of the contour line 1 and are provided with a supporting temporary lining 19, which in most cases will consist of quick-setting concrete. When said line tunnels 17 and 18 have been excavated and lined, the supporting pillars 15 are provided at the top with carrying heads 30 and a bottom plate or slab 21 for the top story of the underground railroad station is placed on the central pillars 15 above the membrane 12 and is joined to the foot portions 6 of the lining 14. The lining 14 is then supplemented by the application of an inner layer 20 to provide the final lining for the top story. As is shown in FIG. 4, the temporary lining 19 of one tubular tunnel 17 or 18 is now destroyed by an action proceeding from that line tunnel and, at the same time, the excavation of the bottom segment 16 is continued from the top segment 13 through suitable apertures in the bottom slab 21, as is shown in FIG. 5 showing the condition at a time when one tubular tunnel has been excavated. Thereafter the lining 19 of the other tubular tunnel is removed from the inside and the excavation of the bottom segment 16 is continued. As the excavation proceeds, a permanent lining 22 for the bottom segment 16 is installed. As soon as the bottom segment 16 has been lined, a bottom fill or bottom slab 23 is provided as a support for the station platforms 24. Continuous wall elements 25 for separating the two station platforms are mounted on the pillars 15 and the lining 22 is supplemented above the slab 23 by an internal lining 26. The means for anchoring and reinforcing the linings 14 and 22 will be selected in dependence on local conditions and of the dimensions of the cavity 13, 16.

Figure 10:
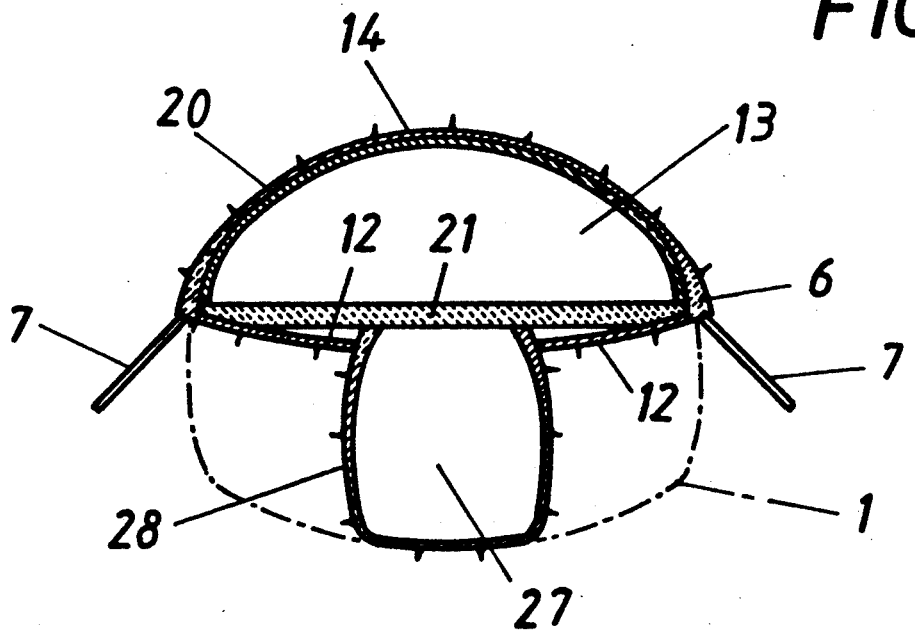
Figure 11:
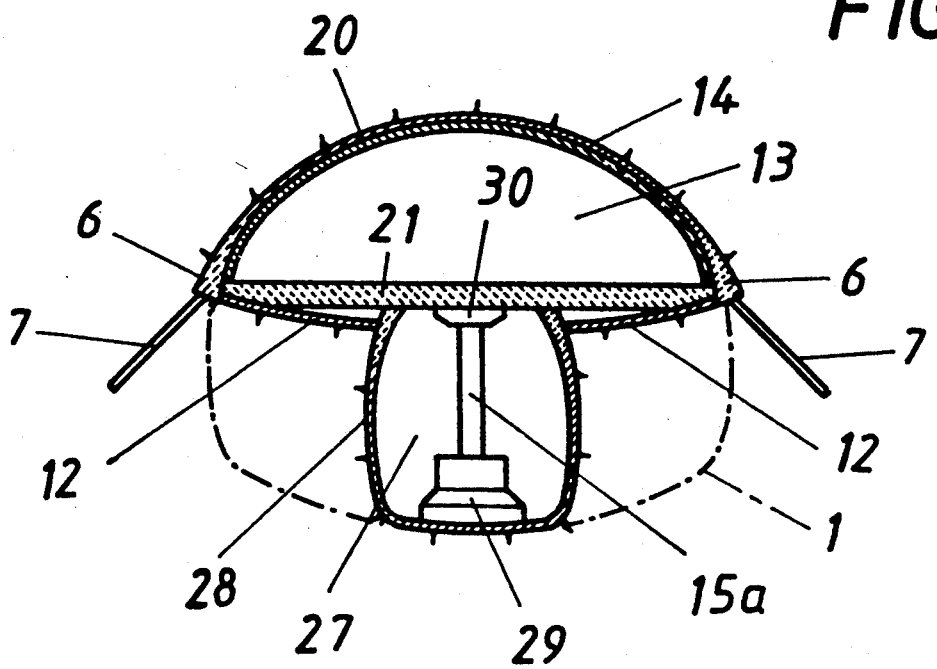
Figure 12:
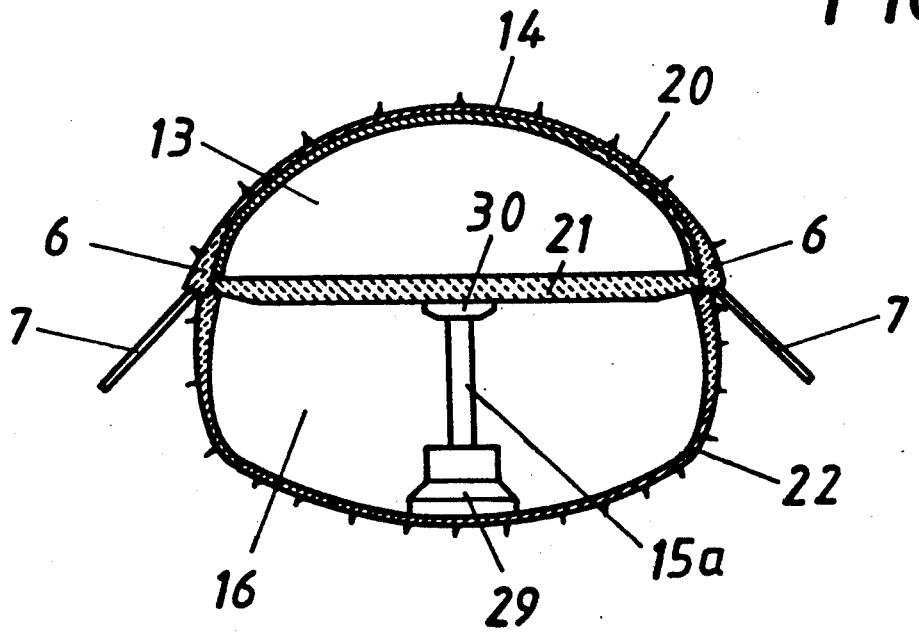
Figure 13:
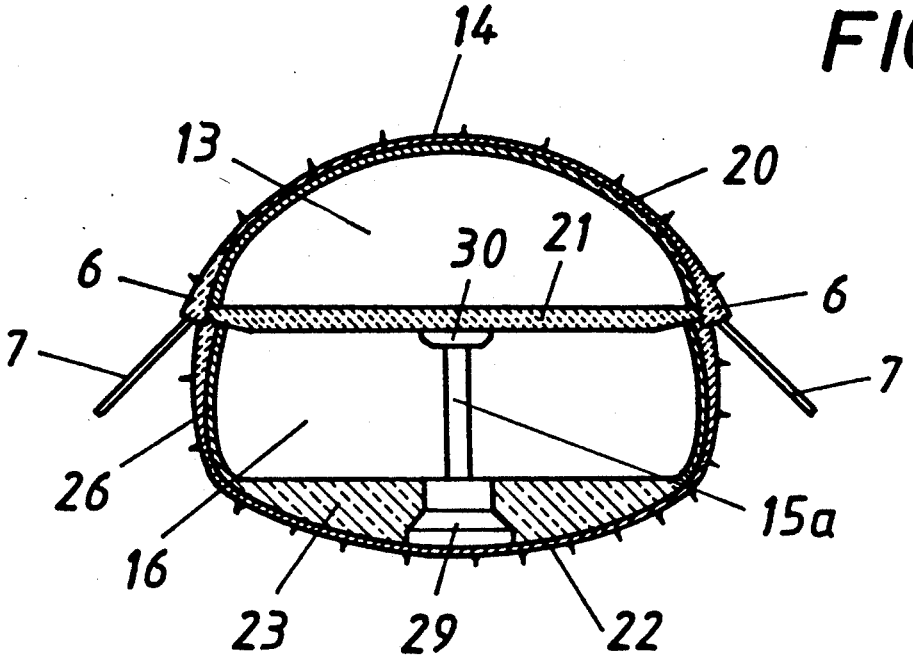
Figure 14:
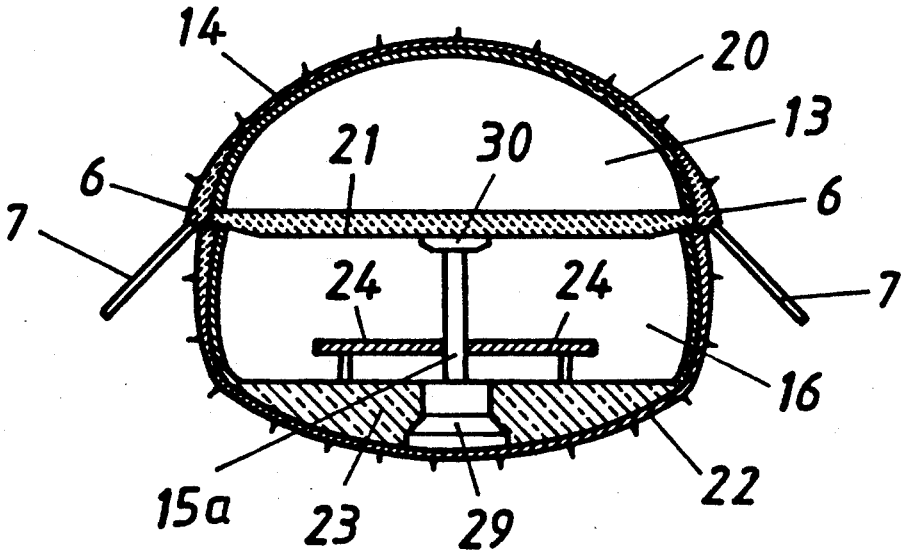

The process illustrated in FIGS. 7 to 14 differs from the process described hereinbefore in that pillars 15*a* are installed in a later process step. In accordance with FIG. 9 the bottom slab 21 is initially installed above the membrane 12 and the lining 14 is supplemented by the lining 20. Thereafter, as is shown in FIG. 10, a central trench 27 extending as far as to the bottom of the desired bottom segment 16 is excavated through apertures in the membrane 12 and optionally through apertures in the slab 21 and said trench 27 is provided with a temporary lining 28. Footings 29 for the pillars 15*a* are placed in the trench 27 and the pillars 15*a* are erected as shown in FIG. 11 and are again provided with head parts 30 for supporting the bottom slab 21. The side portions of the bottom segment 16 of the cavity are now excevated from the trench 27 and with destruction of the remaining portions of the membrane 12 and the permanent lining 22 is provided around the entire bottom segment 16. It is apparent from FIGS. 13 and 14 that in an operation which is similar to that described with reference to FIG. 6 the footings 29 are surrounded by a bottom slab 23 and the station platforms 24 and the lining 22 is supplemented by a layer 26 to form the final lining.

The construction of two stories has been described with reference to FIGS. 1 to 14. In the construction of linings for two stories or of linings which at least in part provide only a single story and extend throughout the height of the permanent lining it is possible to provide supports, particularly pillars, which continuously extend throughout the height of the cavity, or additional pillars 15*b* for supporting the top lining 14 may be placed on the pillars 15 or the head portions 30 or on the bottom slab 21. In that case the pillars 15*b* may be provided with head portions 31 for distributing the load applied by the lining 14 (see broken lines FIG. 2). When different length sections of the cavity are excavated in succession, such pillars 15*b* will increase the carrying capacity of the permanent top lining 14 and the excavation of the top segment 13 may be continued from locations at which linings 14 are provided which are supported by the pillars 15*b*.

We claim:

1. A multi-stage process of excavating a large-volume, elongate underground cavity extending in a longitudinal direction and having a predetermined final cross-section comprised of a top segment extending over the largest width of the cavity cross-section and a bottom segment, which comprises the sequential steps of (a) first excavating two laterally spaced galleries in the top segment in the longitudinal direction, only one of the galleries being excavated at any given time in any given cross-section of the top segment and each one of the galleries having side faces including an outer side face corresponding to a side face of the final top segment cross-section, (b) lining the side faces of the galleries, the outer side faces being lined with permanent linings having a bottom edge, (c) excavating the ground between the two galleries in the top segment to complete the excavation of the top segment, (d) connecting the permanent linings of the outer side faces by a central permanent lining to form a load-bearing vault over the top segment, and (e) finally, protected by the load-bearing vault, excavating the bottom segment and permanently lining the side faces and bottom of the excavated bottom segment.

2. The multi-stage excavating process of claim 1, comprising the further step of driving piles into the ground outside the cross-section of the top segment and outwardly and downwardly inclined from the bottom edges of the permanent linings to retain and support the load-bearing vault.

3. The multi-stage excavating process of claim 1, wherein the side faces of the galleries include an inner side face and a bottom face, and the inner side face and the bottom face are lined with temporary linings, comprising the further step of destroying the temporary linings as the ground between the two galleries is being excavated.

4. The multi-stage excavating process of claim 1, comprising the further step of installing a continuous bottom membrane extending between the bottom edges of the permanent linings after the two galleries and the ground therebetween have been excavated.

5. The multi-stage excavating process of claim 1, wherein the bottom segment is excavated by excavating two laterally spaced tubular tunnels in the bottom segment in the longitudinal direction, the tubular tunnels being spaced from the side faces of the final cross-section of the bottom segment, temporarily lining the tubular tunnels and completing the excavation of the bottom segment from the tubular tunnels and the top segment.

6. The multi-stage excavating process of claim 5, comprising the further step of erecting central support means for the load-bearing vault before the bottom segment has been completely excavated.

7. The multi-stage excavating process of claim 1, comprising the further steps of installing a bottom plate for the top segment, the bottom plate extending between the bottom edges of the permanent linings, and erecting central support means for the load-bearing vault before the bottom segment has been completely excavated.

8. The multi-stage excavating process of claim 1, wherein the bottom segment is excavated from the top segment by first excavating a central trench in the bottom segment in the longitudinal direction, temporarily lining the central trench, installing a bottom plate for the top segment, the bottom plate extending between the bottom edges of the permanent linings, erecting central support means for the bottom plate before the bottom segment has been completely excavated, and completing the excavation of the bottom segment from the central trench.

9. The multi-stage excavating process of claim 1, wherein the load-bearing vault of the top segment is supported on the ground surrounding the final cross-section of the underground cavity while the bottom segment is supported solely by the permanent lining of the side faces and bottom thereof.

* * * * *